US009321062B1

(12) United States Patent
Hawkins, Jr.

(10) Patent No.: US 9,321,062 B1
(45) Date of Patent: Apr. 26, 2016

(54) TROWELING SYSTEM WITH FLUID MISTING COMPONENT

(71) Applicant: Willie E. Hawkins, Jr., Virginia Beach, VA (US)

(72) Inventor: Willie E. Hawkins, Jr., Virginia Beach, VA (US)

( * ) Notice: Subject to any disclaimer, the term of this patent is extended or adjusted under 35 U.S.C. 154(b) by 223 days.

(21) Appl. No.: 14/030,061

(22) Filed: Sep. 18, 2013

(51) Int. Cl.
*A47L 13/26* (2006.01)
*B05B 9/08* (2006.01)

(52) U.S. Cl.
CPC ..... *B05B 9/085* (2013.01)

(58) Field of Classification Search
CPC .... B05B 9/085; B05B 9/0855; B05B 9/0888; A47L 13/26; A47L 1/08; A47L 13/22; A47L 13/30
USPC ..... 239/154, 152, 153, 525; 15/235.4, 15/235.5, 235.6, 235.7, 235.8; 401/9, 139, 401/137, 138
See application file for complete search history.

(56) References Cited

U.S. PATENT DOCUMENTS 1,875,992 A * 9/1932 Clifford ..... 222/321.1
1,902,548 A * 3/1933 Fenwick, Jr. ..... 222/105
2,162,057 A 6/1939 Brandt et al.
3,025,005 A * 3/1962 Dalforn et al. ..... 239/117
3,403,960 A 10/1968 Ballard et al.
4,511,063 A 4/1985 Krause et al.
4,848,660 A * 7/1989 O'Connell ..... 239/154
5,014,884 A * 5/1991 Wunsch ..... 222/333
5,362,165 A * 11/1994 Kluga et al. ..... 401/9
5,478,015 A 12/1995 Black
6,257,448 B1 7/2001 D'Andrade et al.

FOREIGN PATENT DOCUMENTS

GB 000680230 A * 10/1952
GB 000949856 A * 2/1961

* cited by examiner

*Primary Examiner* — Justin Jonaitis

(57) ABSTRACT

A troweling system having an on-demand fluid misting component features a trowel having a trowel blade and a linear handle. The handle features a tubular handle cavity with a fluid pump located in the handle cavity. The system features a trigger located on a handle top surface. The system features a nozzle located on a handle first end that sprays a fluid in a spray pattern in front of the trowel. The system features a fluid container having a strap for wearing on a back of a user. The fluid container features a fluid aperture and a fill aperture. A cap is located on the fill aperture. The system features a hose having a hose first end located on a handle second end and a hose second end located inside the fluid container. The hose second end terminates close to a fluid container bottom surface.

1 Claim, 3 Drawing Sheets

FIG. 3
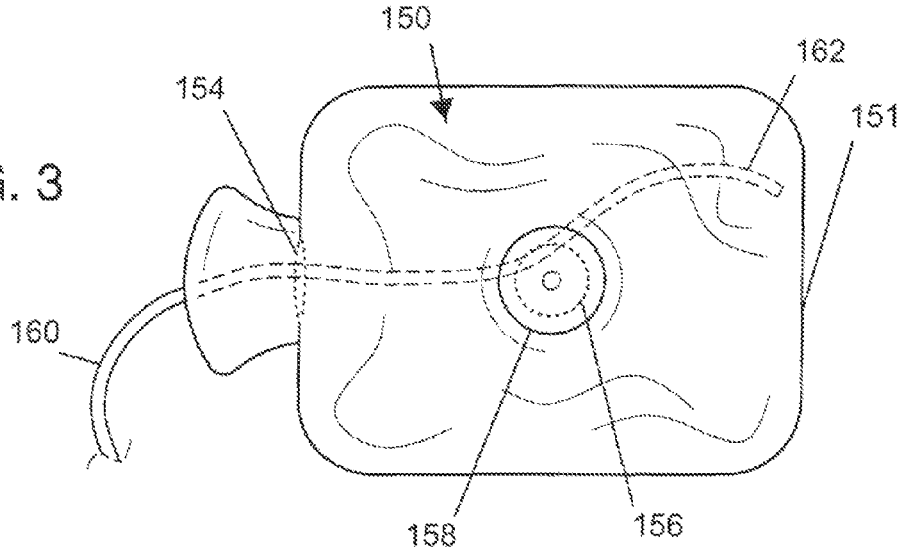
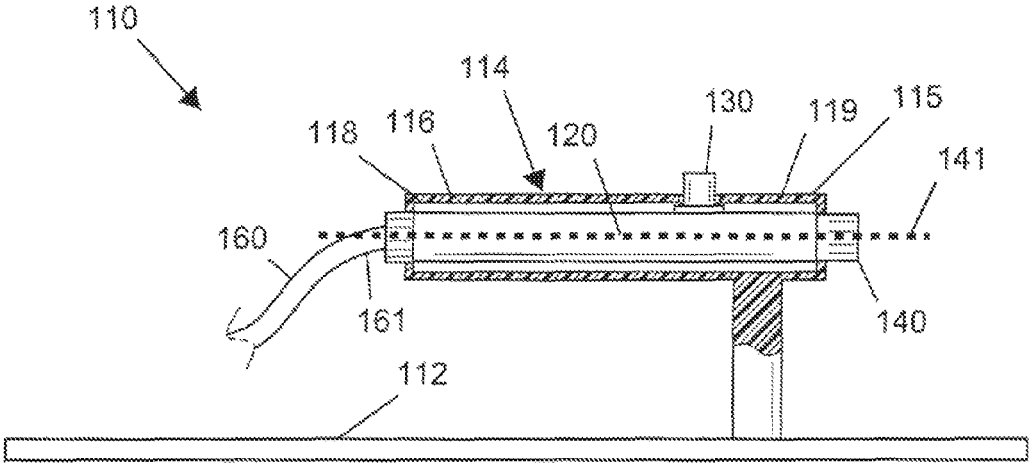
FIG. 4

TROWELING SYSTEM WITH FLUID MISTING COMPONENT

FIELD OF THE INVENTION

The present invention relates to construction tools, or more specifically, construction tools for working with plaster.

BACKGROUND OF THE INVENTION

Troweling systems have been in use in the construction and renovation industries for many years for both interior and exterior use. The compound that is to be troweled, however, has a range of desired wetness for ideal working conditions. This range of desired wetness can change due to evaporation of the liquid in the compound, thus changing the application properties and ultimately the finished appearance of the compound. The present invention features a troweling system having an on-demand fluid misting component.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a troweling system having an on-demand fluid misting component. In some embodiments, the system comprises a trowel having a trowel blade and a linear handle. In some embodiments, the handle comprises a tubular handle cavity. In some embodiments, the system comprises a fluid pump located in the handle cavity. In some embodiments, the system comprises a trigger located on a handle top surface. In some embodiments, the system comprises a nozzle located on a handle first end. In some embodiments, the nozzle sprays a fluid in a spray pattern in front of the trowel.

In some embodiments, the system comprises a fluid container having a strap for wearing on a back of a user. In some embodiments, the fluid container comprises a fluid aperture and a fill aperture. In some embodiments, a cap is located on the fill aperture. In some embodiments, the system comprises a hose having a hose first end located on a handle second end and a hose second end located inside the fluid container. In some embodiments, the hose second end terminates close to a fluid container bottom surface.

BRIEF DESCRIPTION OF THE DRAWINGS

FIG. 3 shows a rear view of the fluid container of the present invention.

FIG. 4 shows a side view of the trowel of the present invention.

DESCRIPTION OF PREFERRED EMBODIMENTS

Figure 1:
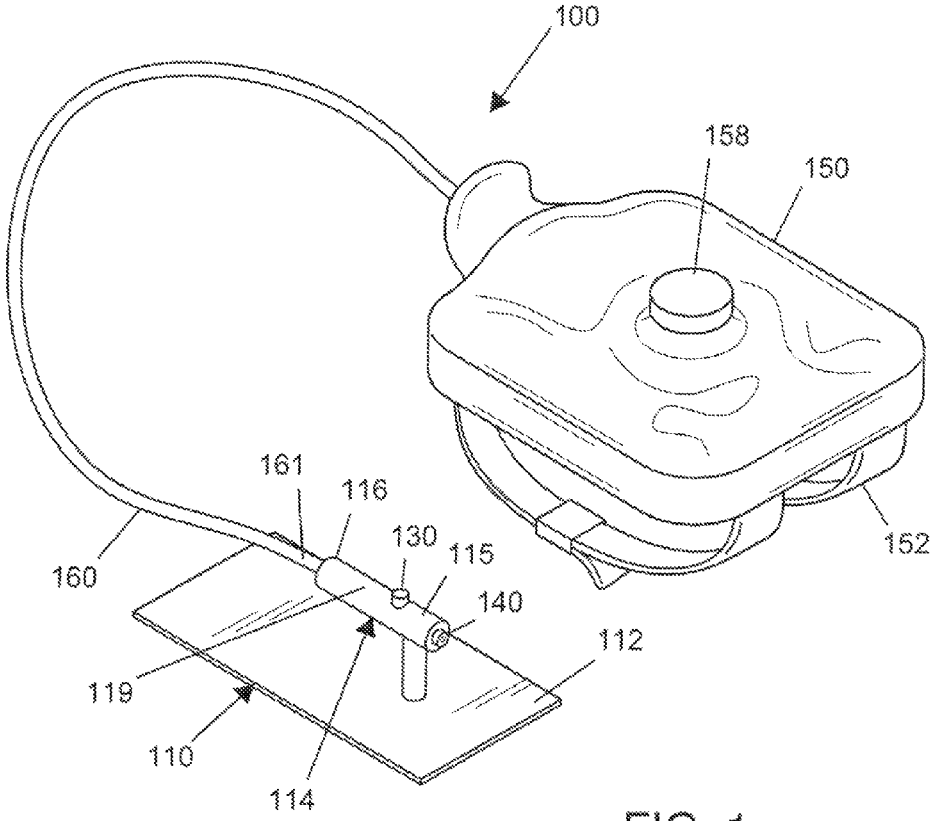
FIG. 1 shows a perspective view of the present invention.
Figure 2:
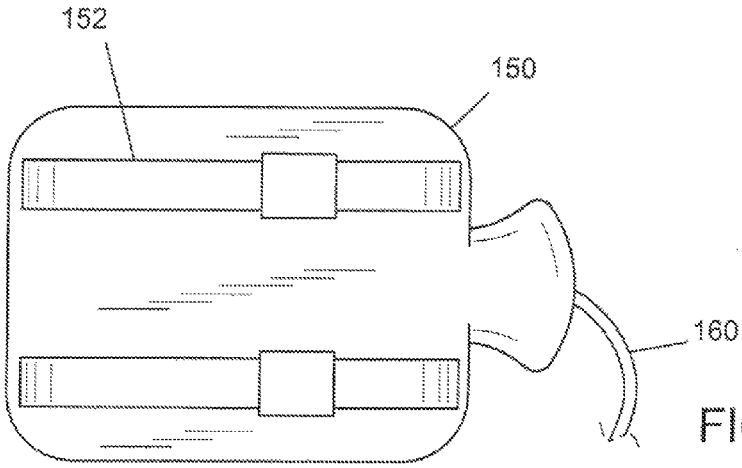
FIG. 2 shows a front view of the fluid container of the present invention.
Figure 5:
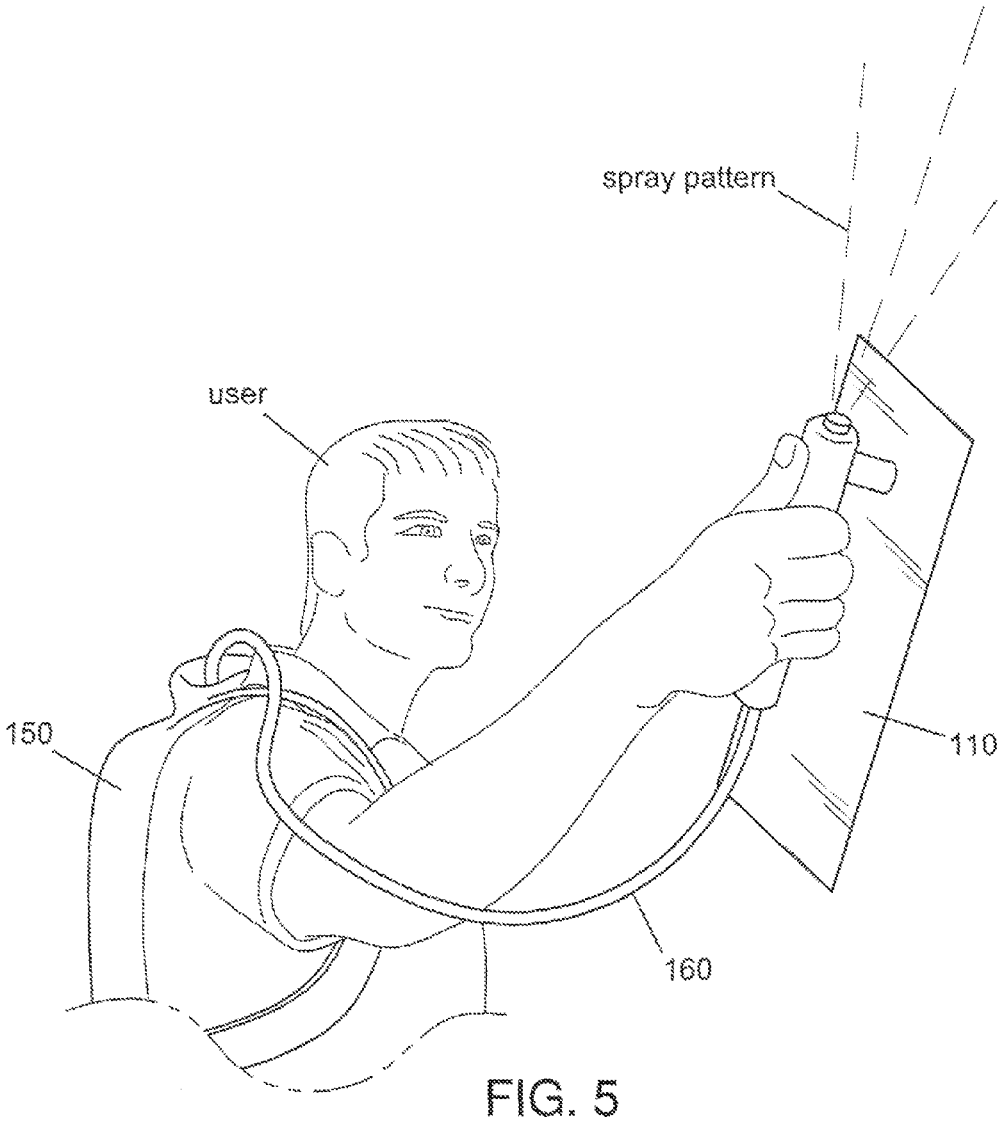
FIG. 5 shows a perspective view of the present invention in use.
Figure 6:
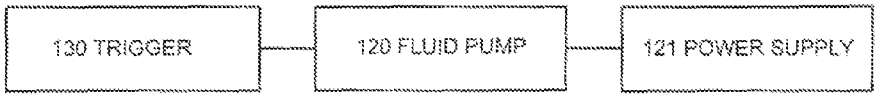
FIG. 6 shows a schematic view of an alternate embodiment of the present invention.

Following is a list of elements corresponding to a particular element referred to herein:

100 Troweling system
110 Trowel
112 Trowel blade
114 Handle
115 Handle first end
116 Handle second end
118 Handle cavity
119 Handle top surface
120 Fluid pump
121 Power supply
130 Trigger
140 Nozzle
141 Axis
150 Fluid container
151 Fluid container bottom surface
152 Strap
154 Fluid aperture
156 Fill aperture
158 Cap
160 Hose
161 Hose first end
162 Hose second end Referring now to FIG. 1-6, the present invention features a troweling system (100) having an on-demand fluid misting component. In some embodiments, the fluid is water. In some embodiments, the system (100) comprises a trowel (110) having a trowel blade (112) and a linear handle (114) located parallel to and in-line with the trowel blade (112). Trowels (110) are well known to those of ordinary skill in the art. In some embodiments, the handle (114) comprises a handle first end (115), a handle second end (116), and a tubular handle cavity (118) located inside the handle (114).

In some embodiments, the system (100) comprises a fluid pump (120) located in the handle cavity (118). In some embodiments, the fluid pump (120) operates on suction. In some embodiments, the fluid pump (120) operates on pressure. Fluid pumps (120) are well known to those of ordinary skill in the art.

In some embodiments, the system (100) comprises a trigger (130) located on a handle top surface (119). In some embodiments, the trigger (130) is operatively connected to the fluid pump (120). In some embodiments, the trigger (130) activates a suction for drawing fluid. In some embodiments, the trigger (130) releases a pressurized fluid. In some embodiments, the trigger (130) is a pumping handle for the fluid pump (120).

In some embodiments, the system (100) comprises a nozzle (140) located on the handle first end (115). In some embodiments, the nozzle (140) is fluidly connected to the pump. In some embodiments, the nozzle (140) sprays a fluid in a spray pattern in front of the trowel (110). In some embodiments, the nozzle (140) lies on an axis (141) parallel to and in-line with the trowel blade (112). In some embodiments, the nozzle (140) is replaceable.

In some embodiments, the system (100) comprises a fluid container (150) having a strap (152) for wearing on a back of a user. In some embodiments, the fluid container (150) comprises two straps (152) for wearing on the back of a user. In some embodiments, the fluid container (150) comprises a fluid aperture (154) and a fill aperture (156) each fluidly located thereon. In some embodiments, a cap (158) is removably located on the fill aperture (156). In some embodiments the fluid container (150) is sealed. In some embodiments, the fluid container (150) is pressurized via another pump. In some embodiments, the cap (158) seals to the fill aperture (156).

In some embodiments, the system (100) comprises a hose (160) having a hose first end (161) located on the handle second end (116) and a hose second end (162) sealably located inside the fluid container (150) through the fluid aperture (154) and terminating inside the fluid container (150). In some embodiments, the hose second end (162) terminates close to a fluid container bottom surface (151). In some embodiments, the hose (160) is fluidly connected to the fluid container (150). In some embodiments, the hose (160) is sealed against the fluid aperture (154). In some embodiments, the hose (160) is limited to a length about equal to a distance between a shoulder blade tip of a user and a tip of a middle finger of a user on a same side. In some embodiments, the hose (160) comprises a length between 30 inches and 60 inches. In some embodiments, the hose (160) is flexible.

In some embodiments, the fluid container (150) is filled with fluid and placed on the back of the user via the strap (152). In some embodiments, the handle (114) is held by the user for troweling. In some embodiments, during troweling, fluid is sprayed by the user via the trigger (130) activating the fluid pump (120).

In some embodiments, the system (100) is advantageous to provide the necessary fluid needed for troweling without accumulating excess fluid on a floor. In some embodiments, the system (100) provides a safety advantage. In some embodiments, the system (100) provides a work efficiency advantage.

In some embodiments, the fluid container (150) is a flexible fluid bottle. In some embodiments, the fluid container (150) resembles a household hot water bottle. In some embodiments, the fluid container (150) is rubber. In some embodiments, the fluid container (150) is plastic.

In some embodiments, the fluid container (150) is a backpack with a fluid bottle located inside.

In some embodiments, the fluid pump (120) is a manual pump. In some embodiments, the fluid pump provides a suction on the fluid container (150) and pressurizes the fluid through the nozzle (140).

In some embodiments, the fluid pump (120) is an electric pump operatively connected to a power supply (121) and the trigger (130). In some embodiments, the electric pump and the power supply (121) are located in the handle cavity (118).

In some embodiments, the nozzle (140) comprises an adjustable spray pattern.

As used herein, the term "about" refers to plus or minus 10% of the referenced number.

The disclosures of the following U.S. Patents are incorporated in their entirety by reference herein: U.S. Pat. No. 6,257,448; U.S. Pat. No. 5,478,015; U.S. Pat. No. 4,511,063; U.S. Pat. No. 3,403,960; and U.S. Pat. No. 2,162,057.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A troweling system (100) having an on-demand fluid misting component, wherein the system (100) consisting of:

(a) a trowel (110) having a trowel blade (112) and a linear handle (114) disposed parallel to and in-line with the trowel blade (112), wherein the handle (114) consisting of a handle first end (115), a handle second end (116), and a tubular handle cavity (118) disposed therein;

(b) a fluid pump (120) disposed in the handle cavity (118);

(c) a trigger (130) disposed on a handle top surface (119), wherein the trigger (130) is operatively connected to the fluid pump (120);

(d) a nozzle (140) disposed on the handle first end (115), wherein the nozzle (140) is fluidly connected to the fluid pump (120), wherein the nozzle (140) sprays a fluid in a spray pattern in front of the trowel (110), wherein the nozzle (140) lies on an axis (141) parallel to and in-line with the trowel blade (112);

(e) a fluid container (150) having a strap (152) for wearing on a back of a user, wherein the fluid container (150) consisting of a fluid aperture (154) and a fill aperture (156) each fluidly disposed thereon, wherein a cap (158) is removably disposed on the fill aperture (156); and (f) a hose (160) having a hose first end (161) disposed on the handle second end (116) and a hose second end (162) sealably disposed inside the fluid container (150) through the fluid aperture (154) and terminating inside the fluid container (150), wherein the hose second end (162) terminates proximal to a fluid container bottom surface (151), wherein the hose (160) is fluidly connected to the fluid container (150);

wherein the fluid container (150) is filled with fluid and placed on the back of the user via the strap (152), wherein the handle (114) is held by the user for troweling, wherein the fluid pump (120) is a manual pump, wherein during troweling the trigger (130) is actuated by a thumb-press to draw a fluid into the fluid pump (120) from the fluid container (150) through the hose (160), wherein the fluid is forced out through the nozzle (140) upon squeezing the trigger (130) with the thumb pressure.

* * * * *